US007476272B2

(12) United States Patent
Defeo et al.

(10) Patent No.: US 7,476,272 B2
(45) Date of Patent: Jan. 13, 2009

(54) ALUMINUM TRIHYDRATE CONTAINING SLURRIES

(75) Inventors: Maureen A. Defeo, West Grove, PA (US); Glenn Richard Evers, Hockessin, DE (US); Patrick F. McIntyre, West Chester, PA (US)

(73) Assignee: E.I. Du Pont de Nemours & Company, Wilmington, DE (US)

( * ) Notice: Subject to any disclaimer, the term of this patent is extended or adjusted under 35 U.S.C. 154(b) by 0 days.

(21) Appl. No.: 11/605,982

(22) Filed: Nov. 29, 2006

(65) Prior Publication Data

US 2007/0068643 A1 Mar. 29, 2007

Related U.S. Application Data

(63) Continuation of application No. 10/629,300, filed on Jul. 28, 2003, now abandoned.

(60) Provisional application No. 60/402,214, filed on Aug. 9, 2002.

(51) Int. Cl.

| | |
|---|---|
| ***C09C 1/02*** | (2006.01) |
| ***C09C 1/36*** | (2006.01) |
| ***D21F 11/00*** | (2006.01) |
| ***D21H 11/00*** | (2006.01) |
| ***D21H 13/00*** | (2006.01) |
| ***D21H 15/00*** | (2006.01) |
| ***C01F 7/02*** | (2006.01) |
| ***C01G 23/047*** | (2006.01) |

(52) U.S. Cl. ..... 106/468; 106/442; 106/445; 106/446; 106/463; 423/610; 423/625; 162/158; 162/161; 162/164.1; 162/181.1; 162/181.2; 162/181.4; 162/181.5; 162/181.8; 162/183; 162/184; 162/185

(58) Field of Classification Search ..... 106/442, 106/445, 446, 483, 15.05, 287.17, 463; 423/610, 423/625; 162/158, 161, 164.1, 181.4, 181.8, 162/181.1, 181.2, 181.5, 183–185
See application file for complete search history.

(56) References Cited

U.S. PATENT DOCUMENTS

| | | | | |
|---|---|---|---|---|
| 4,288,254 | A * | 9/1981 | Gladu | 106/436 |
| 4,376,655 | A | 3/1983 | Weber | |
| 4,610,801 | A | 9/1986 | Matthews et al. | |
| 4,978,396 | A * | 12/1990 | Story | 106/436 |
| 5,015,334 | A | 5/1991 | Derrick | |
| 5,171,631 | A * | 12/1992 | Adkins | 428/328 |
| 5,342,485 | A * | 8/1994 | Armbrust, Jr. | 162/181.5 |
| 5,405,678 | A | 4/1995 | Bilodeau | |
| 5,423,911 | A | 6/1995 | Coutelle et al. | |
| 5,551,975 | A * | 9/1996 | Freeman et al. | 106/485 |
| 5,563,793 | A | 10/1996 | Nakaura | |
| 5,571,379 | A | 11/1996 | Derrick | |
| 5,676,748 | A | 10/1997 | Brown | |
| 5,693,753 | A | 12/1997 | Konig et al. | |
| 5,824,145 | A | 10/1998 | Marganski et al. | |
| 6,040,913 | A | 3/2000 | Johnson | |
| 6,341,560 | B1 | 1/2002 | Shah et al. | |
| 6,387,500 | B1 | 5/2002 | Behl | |
| 6,416,620 | B1 * | 7/2002 | Narancic et al. | 162/5 |
| 6,649,661 | B2 | 11/2003 | Yoshino et al. | |
| 2002/0028288 | A1 * | 3/2002 | Rohrbaugh et al. | 427/180 |
| 2004/0151886 | A1 | 8/2004 | Bobsein et al. | |
| 2006/0252649 | A1 * | 11/2006 | Pluta et al. | 504/367 |

FOREIGN PATENT DOCUMENTS

| | | | |
|---|---|---|---|
| EP | 0 361 763 | * | 9/1989 |
| EP | 0361763 | | 9/1989 |
| GB | 2015490 | | 4/1979 |
| GB | 2117240 | | 3/1983 |
| WO | WO9736050 | | 10/1997 |
| WO | WO 2004/015015 | * | 2/2004 |

OTHER PUBLICATIONS

Definition of alumina trihydrate from Sax et al., "Hawley's Condensed Chemical Dictionary", Eleventh Edition, p. 43.
2003 Product Date Sheet for Almatis Hydral series aluminum trihydroxides.
General Boehmite Information from the Fabre Minerals website: www.fabreminerals.com.

* cited by examiner

*Primary Examiner*—Jerry Lorengo
*Assistant Examiner*—Patricia L Hailey
(74) *Attorney, Agent, or Firm*—Jessica M. Sinnott

(57) ABSTRACT

The present invention relates to Aluminum trihydrate slurries comprising aluminum trihydrate particles, an acrylic dispersant, citric acid, synthetic hectorite clay, optionally a compound to adjust pH, a biocide and water. These slurries may be mixed with titanium dioxide slurries to produce a stable slurry blends useful in paper and paper-board applications.

4 Claims, No Drawings

ALUMINUM TRIHYDRATE CONTAINING SLURRIES

CROSS-REFERENCE TO RELATED APPLICATIONS

This application is a continuation of application Ser. No. 10/629,300 filed Jul. 28, 2003, which claims the benefit of U.S. Provisional Application No. 60/402,214 filed Aug. 9, 2002, which are all incorporated hereinby reference in their entireties.

BACKGROUND OF THE INVENTION

This invention relates to aqueous high solids slurries comprising aluminum trihydrate and blends of such slurries comprising titanium dioxide slurries for use in paper, coatings and plastic applications, especially for use in indirect food-contact paper.

Aluminum trihydrate (ATH) can be used as a filler to produce coatings for paper and paperboard. Because of the relative high cost of titanium dioxide ($TiO_2$), paper mills often replace or extend titanium dioxide with less expensive pigment alternatives, such as ATH, calcium carbonate, kaolin clays and the like. The extender may reduce or eliminate the need for the more expensive white titanium dioxide pigment.

Typically pigments and fillers are introduced into papermaking processes in the form of aqueous slurries. Commercial slurries of ATH are available, but they typically contain organic chemicals that are not compliant with United States Food and Drug Administration (FDA) regulations 21 C.F.R. 176.170 and 21 C.F.R. 176.180 for use in paper with indirect food contact. Even if a paper product is not intended for indirect use with food, paper manufacturers do not typically separate their lines for food and non-food use.

For a slurry to be useful in paper and paper-board applications, the paper manufacturer must be able to pump the slurry from storage into the paper furnish or into the coating make-up area. Pigment slurries at high percent solids are desired to reduce drying energy and increase production rates through the paper coater dryer. High solids slurries combined with low viscosity also improve the flow through the coater to avoid coating scratches and streaks on the final coated paper surface. In order for an ATH slurry to be considered useable as an extender pigment filler or for blending with $TiO_2$ slurry, the ATH pigment solids content should be greater than 50 wt. % and preferably 67.5 wt. % or higher. At such high solids content the available ATH slurries often have unacceptably high viscosities for either indirect use or use as a slurry to be blended with $TiO_2$ slurries.

U.S. Pat. No. 4,376,655 discloses aqueous titanium dioxide slurries comprising ATH and kaolin clays. The ratio of $TiO_2$ to alumina is between 1000:1 and 2000:1. The ATH useful can either be a 9-10% aqueous slurry or a 50-55% dried gel. Preferably the dried gel contains occluded carbonates.

U.S. Pat. No. 5,015,334 discloses a dispersable colloidal silica material, which is a clay, including Laponite® brand synthetic hectorite clays, associated with an anionic organic polymer for use as a retention agent in papermaking.

U.S. Pat. No. 5,171,631 discloses a titanium dioxide pigment ATH extender/spacer pigment composition comprising 70-98% titanium dioxide by volume and 2-30% ATH by volume wherein the ATH has a similar median particles size as the titanium dioxide. Typically the median particle size of the titanium dioxide is 0.2 to 0.3 microns. The ATH has a median particle size within ±20% compared to the titanium dioxide particle size. An example of a coating composition comprising the pigments was prepared with titanium dioxide and ATH and contained a cellulosic thickener, associative thickener, propylene glycol, nonionic surfactant, neutralizer defoamer, coalescing agent and biocide, in water at a solids content of 3.23%.

U.S. Pat. No. 5,342,485 discloses use of ATH with improved whiteness in papermaking to reduce costs relative to using solely $TiO_2$. This patent discusses use of ATH in slurries at 15-30% solids.

U.S. Pat. No. 5,571,379 discloses a composition comprising hectorite clay, acrylic polymer and other additives commonly used in the manufacture of paper or paperboard, including fillers and pigments such as $TiO_2$. There is no disclosure of use with ATH or of hectorite clay reducing the viscosity of an aqueous slurry of $TiO_2$ or ATH.

U.S. Pat. No. 5,676,748 discloses an aqueous slurry for use as providing filler for paper and paperboard products comprising 1 to 30 wt. % solids of mineral particles with a distribution of coarse (>0.5 microns) and fine particles (<0.2 microns) and an anionic acrylic dispersing agent and a cationic flocculating agent. However, slurry of the minerals may be up to 70-76% solids that must be diluted for use, for example, at a paper mill. Examples are limited to kaolin clays.

U.S. Pat. No. 5,824,145 discloses a photodurable titanium dioxide slurry which comprises at least 78% titanium dioxide particles and at least 3% alumina particles along with a dispersant, which can include polyacrylates, alcoholamines, citric acid, and the like with a pH of about 6.0 to 9.0.

U.S. Pat. No. 6,387,500 discloses coating formulations for paper and paperboards comprising aqueous slurries of titanium dioxide pigment with extender pigments, which include ATH and calcined clay, and dispersants, which include acrylates. There is no mention of combining with synthetic hectorite clay to improve viscosity and rheology.

Therefore, there remains a need to decrease the cost of opacity in paper and paper-board applications. There is a need to provide an ATH slurry with improved viscosity and rheological properties. There is a need to find suitable ATH slurry compositions that are of suitable viscosities for use in paper applications including FDA compliant and non-FDA compliant compositions. There is also a need for ATH slurry compositions compatible with titanium dioxide slurries that are stable at suitable viscosities and are FDA compliant for indirect food contact. The present invention meets these needs.

BRIEF SUMMARY OF THE INVENTION

The present invention provides aluminum trihydrate slurries comprising (a) at least 50% by weight of the slurry of dispersed aluminum trihydrate particles having an average particle size of at least 0.5 micron; (b) a dispersant comprising an acrylic dispersing resin, and optionally citric acid; (c) a rheology modifier consisting of a synthetic hectorite clay; (d) optionally a compound to adjust pH; (e) a biocide; and (f) water.

The present invention further provides aluminum trihydrate/rutile titanium dioxide slurry blends comprising (a) at least 50% by weight of the slurry of dispersed aluminum trihydrate particles having an average particle size of at least 0.5 micron; (b) a dispersant comprising an acrylic dispersing resin, and optionally citric acid; (c) a rheology modifier consisting of a synthetic hectorite clay; (d) optionally a compound to adjust pH; (e) a biocide; and (f) water. Preferably the slurry blend comprises from 75 to 50 wt. % $TiO_2$ to 25 to 50 wt. % ATH.

Still further the present invention provides a process for making paper comprising mixing pulp and an ATH/rutile $TiO_2$ slurry blend wherein (a) at least 50% by weight of the slurry of dispersed aluminum trihydrate particles having an average particle size of at least 0.5 micron; (b) a dispersant comprising an acrylic dispersing resin, and optionally citric acid; (c) a rheology modifier consisting of a synthetic hectorite clay; (d) optionally a compound to adjust pH; (e) a biocide; and (f) water.

As used herein aluminum trihydrate means alumina trihydrate defined by the chemical formulas $Al_2O_3$—3HOH or $Al(OH)_3$.

DETAILED DESCRIPTION OF THE INVENTION

The present invention provides aluminum trihydrate slurries which are particularly useful in coatings, paper and paperboard applications. Such slurries typically have greater than 67% ATH pigment solids and are useful for blending as extender pigments with $TiO_2$ slurry for use in paper and coating applications.

Surprisingly, incorporating a synthetic hectorite clay, provides a superior ATH slurry in terms of viscosity and rheological properties as well as improved storage stability by (1) enhancing dispersant(s) effectiveness and reducing viscosity of the ATH slurry; (2) improving wet-in, that is, reducing time needed to incorporate solid pigment particles of ATH into an aqueous slurry and (3) inhibiting low shear settling of 1 micron and larger ATH particles.

ATH Slurry—Components

ATH useful in the present invention is known as pigmentary grade and is characterized by a surface area of from 400 to 1100 $m^2/g$, preferably about 700 $m^2/g$. Preferably it has an average particle size of at least 0.5 micron, and may have an upper limit on particle size as high as 10 microns. Preferably the average particle size is from about 0.50 to 2.0 microns.

It should be recognized that for any given particulate ATH, the particles will be of range of sizes, and the ATH may be characterized by an average particle size and a particle size distribution. Particle size selection in formulating a suitable ATH influences overall slurry properties. For example, particles are smaller than 0.25 microns cause viscosity problems; while particles that are larger than 2.0 microns may lead to settling problems. Pigment grade (pigmentary) ATH is commercially available, for example the Alcoa, Inc. branded product Hydral® 710 and the Alcan, Inc branded GenBrite® 700 product and other ATH products sold as solids, and having a particle size typically about 1 micron.

The ATH slurry of the present invention has an ATH solids content of at least 50% by weight, and up to about 70% by weight, preferably about 67-68% by weight.

The viscosities of the ATH slurries of the present invention as well as for the viscosities of commercial products were measured using either a Brookfield instrument or Tappi methods known in the art and described in more detail hereinbelow.

Water used in the preparation of the ATH slurries of this invention is preferably deionized. That is, the water has been passed through an ion exchange column to remove unwanted ions that may affect the stability and other properties of the slurries. Preferably the metal ion content should provide an electrical resistance less than 0.05 micro-ohm-cm electrical resistivity as measured using ASTM method D 1125.

The ATH slurry of the present invention is stabilized with an acrylic polymer dispersant comprising an acrylic dispersing resins and citric acid. Examples of suitable acrylic dispersing resins include polymers of acrylic acid, especially acrylic acid polymer salts, and particularly, sodium polyacrylate resins, which are commercially available. To satisfy FDA requirements for compliance, the molecular weight of this dispersant should conform to FDA standards set forth in 21 C.F.R. 176.170. Also, the amount of dispersant present in the slurry may be limited to a specific value or range of values required to meet the FDA standards. For uses other than FDA compliant uses, it is not necessary to restrict the level of acrylic dispersant, and the dispersant may be used at any level necessary to achieve optimal stabilization. FDA standards for compliance are provided in 21 C.F.R. 176.170 and 21 C.F.R. 176.180 which are incorporated herein by reference.

Prior to the compositions of the present invention, ATH slurries could not be made that were FDA compliant and, at the same time, having viscosity and rheology properties suitable for use in paper applications. In addition to the selection of the acrylic dispersing resin, for FDA compliant slurries, it is preferred to use a combination of an acrylic dispersing resin with citric acid, for example, sodium polyacrylate and citric acid. Surprisingly the presence of citric acid improves the wet-in of the ATH into the slurry during pigment loading and seems to codisperse the ATH resulting in a lowering of the slurry viscosity. When citric acid is added, it is preferably added in an amount less than 0.1 wt % based on dry weight of ATH. The range os citric acid useful in the present invention is from about 0.05% to about 0.5%. More than about 0.5 wt. % citric acid results in quick settling of the slurry forming a compact and hard heel in a storage container. At least 0.05 wt % is needed to enhance the rate of dry ATH wet in during the dispersing process, but about 0.1 wt % is preferred amount.

ATH slurry compositions of the present invention include a synthetic hectorite. Synthetic hectorite has the formula:

$$[Mg_wLi_xSi_8O_{20}H_{4-y}F_y]^{2-}$$

wherein w=3 to 6; x=0 to 3; y=0 to 4; z=12−2w−x, wherein the negative lattice charge is balanced by counterions, and wherein the counterions are selected from the group consisting of $Na^+$, $K^+$, $NH_4^+$, $Li^+$, $Mg^{2+}$, $Ca^{2+}$, $Ba^{2+}$, $N(CH_3)_4^+$, and mixtures thereof.

Synthetic hectorite resembles natural clay mineral hectorite and is a layered hydrous magnesium silicate, which is free from natural clay impurities. Synthetic hectorite is commercially available, for example, from Southern Clay Products, Inc., and includes the brands Laponite®; Lucenite SWN®, Laponite S®, Laponite XL®, Laponite RD® and Laponite RDS® of synthetic hectorite. The present inventors have discovered that unlike other clays commonly present in papermaking slurries comprising ATH, the synthetic hectorite provides the dual benefits of enhancing the rheology of the ATH slurries while as reducing the viscosity during shear.

In the ATH slurries of this invention, the synthetic hectorite is present in an amount from 0.1 up to about 1%, preferably about 0.3% by weight of the total slurry formulation. Surprisingly it has been found that when synthetic hectorite clay, is present in an aqueous ATH slurry, the viscosity of the slurry is dramatically reduced. This is surprising since synthetic hectorite is known to produce thickened liquids or gels, and, is commonly used to increase viscosity for water-based slurries and paints, The synthetic hectorite, in contrast, natural clays are ineffective at reducing the viscosity and providing Theological benefits in an ATH slurry. In fact, such clays increase viscosity as a function of the amount present.

Frequently, it may be necessary to adjust the pH to the desired pH range. An amine is generally used for this purpose. Typical amines suitable for use in the present invention include amines, especially alcohol amines, such as 2-amino-2-methyl-1-propanol ("AMP") and monoisopropanolamine ("MIPA"). Other suitable amines include 1-amino-2-ethanol, 2-amino-1-ethanol, 1-amino-2-propanol, diethanolamine, diisopropanolamine, and 2-methylamino-1-ethanol.

While other alkaline additives may be used, such as inorganic bases, care should be taken to avoid possible interference such as metal ion interference with the dispersant selection. When used, the selected amine or inorganic base is typically present in the slurry at an amount to maintain the pH of the product slurry in the range of 8.5 to 11, preferably 9 to 9.5.

For FDA compliance when using MIPA, the permissible concentration range is from 0.01 up to 0.25% based on total slurry formulation level, with a typical level of 0.14%.

Any commercially available biocide can be used in the slurry of this invention. Preferably the biocide used is identified as FDA compliant or is present in the slurry in a concentration not more than is FDA compliant for indirect food contact. Examples of such biocides include, but are not limited to: 1,2-benzisothiazolin-3-one, Proxel GXL, [i] available from Avecia, Inc., 2-bromo-2-nitro-1,3-propanediol, glutaraldehyde, and 3,5-dimethyl-1,3,5-, 2H-tetrahydrothiadiazine-2-thione. The amount of biocide in an ATH slurry of the present invention is typically in the range of 50 to 500 ppm, based on the weight of the slurry solids. Preferably, the amount of biocide is about 400 ppm in an ATH slurry. Typically the amount of biocide in a blended ATH/$TiO_2$ slurry of the present invention is in the range of 25 to 250 ppm, based on the weight of the slurry solids. Preferably the amount of biocide is about 100 ppm in a blended ATH/$TiO_2$ slurry.

Advantageously, rutile titanium dioxide may be combined with the ATH slurry of the present invention to provide a mixed ATH/$TiO_2$ slurry blend to provide a slurry having comparable to a commercial anatase slurry, but at a reduced $TiO_2$ concentration. Such mixed slurries are useful for providing at least comparable opacity in paper and paper-board applications at a competitive cost than anatase $TiO_2$ slurries. When an ATH slurry is blended with a rutile titanium dioxide slurry, for best results, each slurry should be a high solids slurry. For example, preferably the ATH slurry will have a solids level of at least 67.5 wt. %. The titanium dioxide slurry may have a solids content from 50 wt. % to as high as 92 wt. %. A particularly useful rutile titanium dioxide slurry has a solids content of 71 wt. %. Suitable rutile titanium dioxide slurries for use in blending with a high solids ATH slurry include any stable high solids rutile slurries with compatible dispersants and other components. An example of a rutile titanium dioxide slurry particularly suitable for use with the ATH slurries of this invention is a titanium dioxide slurry prepared using dilatant grinding, especially those produced by the process of U.S. Pat. No. 5,563,793, the teachings of which are hereby incorporated by reference.

When a rutile titanium dioxide slurry is combined with the ATH slurry of this invention, a preferred slurry blend comprises about 75% titanium dioxide and about 25% ATH slurry on a pigment weight basis. The titanium dioxide content may be higher, with conversely lower amounts of ATH. As the titanium dioxide content of the slurry is increased, the opacity achieved at a given slurry concentration is increased, but there is the corresponding increase in the cost of a slurry. An ATH/rutile $TiO_2$ blended slurry composition having about 75 wt. % $TiO_2$ and 25 wt. % ATH provides opacity and brightness equal to a conventional (100%) anatase $TiO_2$ slurries used in paper and paperboard manufacture. Similar blends of ATH slurries and $TiO_2$ slurries are also useful for coatings, such as architectural and paper coatings, and other applications, including plastics.

Characteristics/Properties of the ATH Slurries of the Invention

The ATH slurries of the present invention are high solids slurries comprising at least 50% by weight ATH, and up to 70% by weight ATH, preferably 67-68% ATH. The ATH slurries have good stability. The ATH slurries have a low grit content, that is, less than 0.01% unbrushed grit. The high solids ATH slurries of this invention have low viscosity. Viscosity is measured using a Brookfield viscometer. The viscosity of the high solids ATH slurries is less than 1500 Cps at 20 rpm, using a #3 spindle, preferably less than 1000 Cps and more preferably in the range of 200 to 800 Cps, measured at room temperature and 68% solids. The ATH slurries of this invention are pumpable. "Pumpable" is defined herein as having a Hercules viscosity of less than 125 cps, and preferably less than 100 as measured using a Hercules High Shear Viscometer with an "A" bob, a spring setting of 50,000 dynes/cm and 500 rpm shear rate.

The ATH/$TiO_2$ slurry blend of this invention is useful in paper and paper-board applications. The present invention provides a process for making paper comprising mixing pulp and a slurry comprising ATH and rutile $TiO_2$ pigment particles to form a stock and dewatering and drying the stock to form a sheet wherein the slurry comprises (a) at least 50% by weight of dispersed ATH pigmentary particles having an average particle size of at least 0.5 micron; (b) a dispersant comprising an acrylic dispersing resin, and optionally citric acid; (c) a synthetic hectorite clay; (d) optionally a compound to adjust pH; (e) a biocide; and (f) water. Preferably the slurry comprises from 75 to about 50% by weight of rutile $TiO_2$ and from 25 to about 50% ATH.

EXAMPLES

Test Methods

Various test methods were employed to characterize the ATH slurries and ATH/$TiO_2$ blended slurries of this invention. The pH of the slurries were measured using a Beckman model 200 pH meter and a Corning flat surface combination wRJ electrode. Brookfield viscosity was measured using a standard Brookfield Digital Viscometer, model RTVTD-II, available from Brookfield Engineering Company.

Tappi standard test method T646 was used as the procedure for determination of the low- and high shear viscosity of slurry pigments. Pigment rheology test conditions used an "A" or an "E" bob over a shear range of 0-4400 rpm, and a 50,000 dyne/cm spring setting for low viscosity slurries and a 100,000 dyne /cm spring setting for high viscosity slurries. The Hercules Hi Shear Viscometer is available from Kaltec Scientific Instrument, Inc.

General Process

The slurries of this invention were prepared using a lab-scale Dispermat model AE5C high-speed disperser, HSD, equipped with a 60 mm Cowles blade. All slurry preparations were performed in a cylindrical stainless steel vessel measuring 4 inches in diameter and 6 inches high. To a high speed disperser was added deionized water and Laponite RD® brand synthetic hectorite, in the amounts provided in the tables, corresponding to the examples, with stirring for 30 minutes at low speed (approx. 200 to 400 rpm) to achieve adequate hydration. Reagent for pH adjustment (such as monoisopropanolamine) as well as dispersants and biocides were slowly added and mixed for 10 minutes at low speed until uniform. ATH was then added slowly and mixed at high speed (approx. 1800 to 2000 rpm) for 15 minutes. Additional deionized water was added followed by mixing for 10 minutes at low speed to achieve adequate uniformity.

Example 1 and Comparative Examples A-D

The General Process was followed with the compositions provided in Table 1. Synthetic hectorite clay and comparative clays, which are natural clays, (were first hydrated in deionized water using an air mixer for 30 minutes. The acrylic dispersing resin was 602N Alcosperse® brand sodium polyacrylate available from National Starch and Chemical Company, Berkely, Calif. Example 1 took 5 minutes to incorporate ATH into the slurry, while the other samples took much longer (9-10 minutes). Properties of the slurries produced are provided in Table 2.

TABLE 1

Amounts for Reagents for Example 1 and Comparative Examples A-D, in grams

| Reagent | Tradename, if applicable | Examples A | B | 1 | C | D |
|---|---|---|---|---|---|---|
| Aluminum trihydrate | GenBrite ® | 675 | 675 | 675 | 675 | 675 |
| Dispersants | Alcosperse ® 602, 45% | 12.5 | 12.5 | 12.5 | 12.5 | 12.5 |
| Bentonite | Bentolite ® WH | 0.5 | 0 | 0 | 0 | 0 |
| Bentonite | Permont ® SX 10 | 0 | 1 | 0 | 0 | 0 |
| Synthetic Hectorite | Laponite RD ® | 0 | 0 | 1.5 | 0 | 0 |
| Bentonite | Bentolite ® L10 | 0 | 0 | 0 | 0.5 | 0 |
| Deionized water, initial | | 257 | 256.5 | 256 | 257 | 257.5 |
| Deionized water (let down) | | 55 | 55 | 55 | 55 | 55 |

All clays are commercially available from Southern Clay, Inc., Gonzalez, TX.

TABLE 2

Properties of Example 1 and Comparative Examples A-D

| Measurement | Examples A | B | 1 | C | D |
|---|---|---|---|---|---|
| Brookfield viscosity 10 rpm/spindle 1 day | 9000/5 | 8160/5 | 2460/3 | 9500/5 | 7000/3 |
| Brookfield viscosity 20 rpm/spindle 1 day | 5500/5 | 4920/5 | 1540/3 | 5700/5 | 4010/3 |
| Brookfield viscosity 100 rpm/spindle 1 day | 1750/5 | 1400/5 | 548/3 | 1700/5 | 1200/4 |
| pH | 10.15 | 10.2 | 10.18 | 10.16 | 10.31 |
| Hercules viscosity 1 day RT* | Too viscous | Too viscous | 74.5 | Too viscous | 114.6 |

*RT = room temperature

As can be seen from Table 2, only the synthetic hectorite clay formed a stable aqueous slurry containing the ATH. The comparative clays all formed very viscous, non-pumpable mixtures. The viscosities of slurries containing the comparative clays were higher than the viscosity of the slurry containing ATH alone.

Example 2 and Comparative Examples E-G

The process of Example 1 was repeated, using larger amounts of the comparative clays, with compositions provided in Table 3. All clays were first hydrated in deionized water for 30 minutes. Example 2 took 10 minutes to bring ATH into solutions whereas the comparative examples took 12-15 minutes, with comparative example G needing additional water. Properties of the slurries are provided in Table 4.

TABLE 3

Amounts for Reagents for Example 2 and Comparative Examples E-G, in grams

| Reagent | Tradename, if applicable | Examples E | F | 2 | G |
|---|---|---|---|---|---|
| Aluminum trihydrate | GenBrite ® | 675 | 675 | 675 | 675 |
| Dispersants | Alcosperse ® 602, 45% | 12.5 | 12.5 | 12.5 | 12.5 |
| Bentonite | Bentolite ® WH | 3 | 0 | 0 | 0 |
| Bentonite | Permont ® SX 10 | 0 | 3 | 0 | 0 |
| Synthetic Hectorite | Laponite RD ® | 0 | 0 | 3 | 0 |
| Bentonite | Bentolite ® L10 | 0 | 0 | 0 | 3 |
| Deionized water, initial | | 254.5 | 254.5 | 254.5 | 254.5 |
| Deionized water (let down) | | 55 | 55 | 55 | 55 |

TABLE 4

Properties of Example 2 and Comparative Examples A-D

| Measurement | Examples E | F | 2 | G |
|---|---|---|---|---|
| Brookfield viscosity 10 rpm/spindle 1 day | 35000/7 | 5840/3 | 1920/3 | 12000/5 |
| Brookfield viscosity 20 rpm/spindle 1 day | 31200/7 | 3820/3 | 1230/3 | 7800/5 |
| Brookfield viscosity 100 rpm/spindle 1 day | 11000/7 | 1700/4 | 470/3 | 2230/5 |
| PH | 10.08 | 9.95 | 10.04 | 9.62 |
| Hercules viscosity 1 day RT* | Too viscous | Too viscous | 66.9 | 112.7 |

*Too thick to measure

As can be seen from Table 4, even with higher amounts of the comparative clays, there was no improvement in viscosity relative to that observed with the synthetic hectorite clay. Furthermore, higher levels of the comparative clays resulted in higher viscosities than those in Table 2.

Examples 3-4 and Comparative Examples H-I

The General Process was followed with the compositions provided in Table 5. Examples 3 and 4 both have the synthetic hectorite whereas Comparative Examples H-I do not. In addition, Example 4 uses less of the acrylic dispersing resin than Example 12 and has citric acid present. Note that the resulting combination when all starting reagents had been added resulted in a pH of 9.81, thus, no pH modifier was used. Properties of the slurries produced are provided in Table 6.

TABLE 5

Amounts for Reagents for Examples 3-4 and Comparative Examples H-I, in grams

| Reagent | Tradename, if applicable | Example H | 3 | I | 4 |
|---|---|---|---|---|---|
| Aluminum trihydrate | GenBrite ® 700 | 675 | 675 | 675 | 675 |
| Dispersants | Alcosperse ® 602, 45% | 12.5 | 12.5 | 3.6 | 3.6 |
| | Citric acid | 0 | 0 | 1 | 1 |
| pH adjuster | MIPA | 0 | 0 | 1.4 | 1.4 |
| Synthetic hectorite | Laponite RD ® | 0 | 3 | 0 | 3 |
| Deionized water, initial | | 267.5 | 254.5 | 269 | 266 |
| Deionized water (let down) | | 45 | 55 | 50 | 50 |

TABLE 6

Properties of Examples 3-4 and Comparative Examples H-I

| Measurement | Examples H | 3 | I | 4 |
|---|---|---|---|---|
| Brookfield viscosity 10 rpms/spindle 1 day RT | 11220/6 | 2130/3 | 7000/3 | 1120/3 |
| Brookfield viscosity 20 rpms/spindle 1 day RT | 6700/6 | 1350/3 | 4580/3 | 830/3 |
| Brookfield viscosity 100 rpms/spindle 1 day RT | 1900/6 | 490/3 | 1500/3 | 392/3 |
| pH—day of preparation | 9.82 | 9.81 | 9.37 | 9.37 |
| Hercules viscosity 1 day RT* | 89.8 | 74.5 | 133.7 | 66.9 |
| Brookfield viscosity 7 days RT 10 rpms/spindle | 12600/6 | 2130/3 | 7340/4 | 1080/3 |
| Brookfield viscosity 7 days RT 20 rpms/spindle | 7950/6 | 1350/3 | 4760/4 | 780/3 |
| Brookfield viscosity 7 days RT 100 rpms/spindle | 2420/6 | 502/3 | 1670/4 | 390/3 |
| pH—7 days RT | 10.1 | 10.18 | 9.85 | 9.75 |
| Hercules viscosity day 7 RT | 156.6 | 64.9 | 212.0 | 105.0 |
| Brookfield viscosity 7 days 140 F. 10 rpms/spindle | 2750/6 | 2810/3 | 16500/4 | 1590/3 |
| Brookfield viscosity 7 days 140 F. 20 rpms/spindle | 16300/6 | 1770/3 | 9750/5 | 1220/3 |
| Brookfield viscosity 140 F. 7 days 100 rpms/spindle | 4420/6 | 653/3 | 3190/5 | 580/3 |
| pH—7 days 140 F. | 10.29 | 10.22 | 9.83 | 9.76 |
| Hercules viscosity day 7 140 F. | 206.3 | 53.5 | 194.8 | 76.4 |

Brookfield and Hercules viscosities are reported in centipoise.

As can be seen from Table 6, the presence of the synthetic hectorite in the slurry of ATH, GenBrite® 700 brand ATH, significantly reduced the viscosity of the slurries, comparing Examples 3 and 4 with Comparative Examples H and 1, respectively. In addition, when less acrylic dispersing resin is used (in order to comply with FDA standards), but is used in combination with citric acid, there is reduction in viscosity and rheology, compared to Example 3 in which the slurry contains more acrylic dispersant, but does not contain any citric acid.

Examples 5 and 6 and Comparative Examples J and K

The process of Examples 3 and 4 and Comparative Examples H and I was repeated, using a different commercial ATH sample, with compositions provided in Table 7. The commercial ATH sample was Hydral®710, a precipitated white aluminum trihydroxide $Al(OH)_3$ commercially available from Almatis GmbH of Frankfurt Germany. Properties of the slurries produced are provided in Table 8.

TABLE 7

Amounts for Reagents for Examples 5-6 and Comparative Examples J-K, in grams

| Reagent | Tradenames if applicable | Examples J | 5 | K | 6 |
|---|---|---|---|---|---|
| Aluminum trihydrate | Hydral ® 710 flash dried | 675 | 675 | 675 | 675 |
| Dispersants | Alcosperse ® 602, 45% | 12.5 | 12.5 | 3.6 | 3.6 |
| | Citric acid | 0 | 0 | 1 | 1 |
| pH adjuster | MIPA | 0 | 0 | 1.4 | 1.4 |
| Synthetic hectorite | Laponite RD ® | 0 | 3 | 0 | 3 |
| Deionized water, initial | | 252.5 | 239.5 | 269 | 266 |
| Deionized water (let down) | | 60 | 70 | 50 | 50 |

TABLE 8

Properties of Examples 5-6 and Comparative Examples J-K

| Measurement | Examples J | Examples 5 | Examples K | Examples 6 |
|---|---|---|---|---|
| Brookfield viscosity 10 rpms/spindle 1 day RT | 4640/3 | 1770/3 | 7700/5 | 1940/3 |
| Brookfield viscosity 20 rpms/spindle 1 day RT | 3140/3 | 1100/3 | 6540/5 | 1330/3 |
| Brookfield viscosity 100 rpms/spindle 1 day RT | 1550/3 | 416/3 | 2480/5 | 560/3 |
| pH—day of preparation | 10.38 | 10.4 | 9.82 | 9.88 |
| Hercules viscosity 1 day RT* | 84.0 | 49.7 | 154.7 | 95.5 |
| Brookfield viscosity 7 days RT 10 rpms/spindle | 5300/6 | 1900/3 | 8500/5 | 1950/3 |
| Brookfield viscosity 7 days RT 20 rpms/spindle | 3580/3 | 1230/3 | 5750/5 | 1380/3 |
| Brookfield viscosity 7 days RT 100 rpms/spindle | 1480/5 | 450/3 | 2400/5 | 679/3 |
| pH—7 days RT | 10.55 | 10.54 | 9.71 | 10.1 |
| Brookfield viscosity 7 days 140 F. 10 rpms/spindle | 12000/5 | 2580/3 | 12000/5 | 2820/3 |
| Brookfield viscosity 7 days 140 F. 20 rpms/spindle | 7750/5 | 1660/3 | 8000/3 | 2090/3 |
| Brookfield viscosity 140 F. 7 days 100 rpms/spindle | 2560/5 | 628/3 | 2750/5 | 1040/4 |
| pH—7 days 140 F. | 10.39 | 10.43 | 9.94 | 10.13 |

As can be seen from Table 7, the synthetic hectorite, Laponite RD®, in the aqueous slurry of ATH, Hydral® 710 flash dried, significantly reduced the viscosity of the slurries, comparing Examples 5 and 6 with Comparative Examples J and K. The viscosities of the slurries decrease when the synthetic hectorite is added, comparing Example 5 with Comparative Example J and comparing Example 6 with Comparative Example K. The viscosities of the slurries containing the citric acid are comparable to the slurries not containing citric acid, but overall containing a much higher concentration of dispersants. That is, the viscosity of the slurry of Example 6 was nearly equal to the viscosity of the slurry of Example 5 although the slurry of Example 6 contained substantially less dispersant.

Example 7

An ATH slurry was prepared according to Example 4 using GenBrite® 700 brand ATH on a 250-gallon high speed disperser. The ATH slurry was blended with a rutile titanium dioxide slurry prepared according to U.S. Pat. No. 5,693,753, using MIPA as a dispersant, at a ratio, based on the weight of the dry pigment, of 75 parts $TiO_2$ to 25 parts ATH. Table 9 provides the properties of the slurries and slurry blend.

TABLE 9

Properties of starting ATH, $TiO_2$ and ATH/$TiO_2$ blended slurries.

| Slurry | pH | wt. % Solids | Brookfield Viscosity (@100 rpm, #4 Spindle, 25° C.) (Cp) | Hercules High Shear Viscosity (Cp) |
|---|---|---|---|---|
| Rutile $TiO_2$ | 9.0 | 71.1 | 118 | 16.8* |
| 75/25 Blend | 8.8 | 70.48 | 104 | 22.3* |
| ATH | 8.8 | 68.2 | 228 | 54.4** |

*Measured using an "E" Bob, 50,000 dyne/cm at 500 rpm.
**Measured using an "A" Bob, 50,000 dyne/cm at 500 rpm.

Example 8

Relative optical density (OD) test, as described in U.S. Pat. No. 6,040,913, was used to compare the light scattering efficiency of the pigment slurries described in Example 7. The higher the relative optical density number, the better the light scattering efficiency.

Total transmission for each of a series of pigment slurries was measured using a 1-cm path length cell on a Hunter Ultrascan™ spectrophotometer (available from HunterLab, Reston, Va.) equipped with an integrating sphere to provide analysis of total transmittance. Measurements were recorded at wavelength of 700 nm.

Table 10 provides the relative OD of the specified pigment slurries using a rutile $TiO_2$ slurry prepared according to according to U.S. Pat. No. 5,693,753, using AMP as a dispersant, as the standard. Comparisons are made with the rutile $TiO_2$ slurry prepared in Example 7, the ATH slurry prepared in Example 7, the blended ATH/$TiO_2$ slurry prepared in Example 7 and two commercial anatase titanium dioxide slurries, T-4000 and A-2000, available from Millenium Chemicals, Inc.

TABLE 10

Relative Scattering Efficiency based on Relative Optical Pigment Density divided by Concentration measured at 700 nm.

| Slurry | Relative Scattering Efficiency |
|---|---|
| Rutile $TiO_2$ prepared with AMP | 1.00 |
| Example 7 Rutile $TiO_2$ prepared with MIPA | 1.12 |
| Example 7 ATH/$TiO_2$ blend | 0.86 |
| T-4000 | 0.86 |
| T-2000 | 0.80 |
| Example 7 ATH | 0.05 |

*(standard deviation = 0.005)

As can be seen from Table 10, the ATH/$TiO_2$ slurry blend of this invention has OD numbers equivalent to or better than the comparative commercial anatase slurries.

Examples 9-11

The ATH/$TiO_2$ slurry blend from Example 7 was used to make coatings for a coated recycle paper -board application across a range of ATH/$TiO_2$ pigment blend additions showing that the slurry blend of the present invention may be used as the titanium dioxide containing component of a paper coating. The coatings were made using the raw materials and formulations provided in Table 11. Following the order of raw material addition listed in Table 11, a Cowles mixer was first used at high shear to make the pigment grind, then at low shear to make the coating reduction. The coatings were then drawn down on a pre-coated recycle board using either a 10 or 12 point rod to achieve the target coat weight of 3.5 lb/1000 $ft^2$, and air dried. The coated board Examples were then calendered to achieve the target 75° gloss of 50, and pH of 8.5±0.3 at the target coat weight. The coating formulation, make-down, and coating application were typical for the coated recycle board market. The properties of the Examples are provided in Table 12.

TABLE 11

Raw Materials and Order of Addition for Examples 9-11.

| Raw Material | Order of Addition | Example 9 (parts) | Example 10 (parts) | Example 11 (parts) |
|---|---|---|---|---|
| Clays | | | | |
| Kaolin clay (a) | 2 | 71 | 67 | 63 |
| Calcined kaolin clay (b) | 3 | 10 | 10 | 10 |
| ATH/$TiO_2$ slurry blend from Example 7 | 4 | 19 | 23 | 27 |
| Binders | | | | |
| Modified styrene-butadiene latex (c) | 6 | 18 | 18 | 18 |
| Soy polymer (d) | 5 | 4 | 4 | 4 |
| Lubricant | | | | |
| Calcium stearate (e) | 7 | 0.3 | 0.3 | 0.3 |
| Dispersant | | | | |
| Low molecular weight polyacrylate (f) | 1 | 0.1 | 0.1 | 0.1 |
| Thickener | | | | |
| Ammonium zirconium carbonate (g) | 8 | 0.4 | 0.4 | 0.4 |
| Water | | | | |
| Total Parts | | 122.8 | 122.8 | 122.8 |

(a) Hydrafine clay, available from J. M. Huber Corp., Macon, GA.
(b) Alphatex clay, available from Imerys, Roswell, GA.
(c) PB 6620 binder, available from Dow Chemical Company, Midland, MI.
(d) "PRO-COTE" soy polymer, available from E. I. du Pont de Nemours and Company, Inc., Wilmington, DE.
(e) "GLOSCOTE 50", available from Eka Chemicals, North America, Marietta, GA.
(f) "RHODALINE 211", available from Rhodia USA, Cranberry, NJ.
(g) "AZCOTE 5800", available from Eka Chemicals, North America, Marietta, GA.

TABLE 12

Coating Data for Examples 9-11.

| Example No. | Parts Example 7 | Coating % Solids | Coating pH | Spindle # | Brookfield Viscosity cps @ 20 rpm | Brookfield Viscosity cps @ 100 rpm | Temp. ° F. |
|---|---|---|---|---|---|---|---|
| 9 | 19 | 58.29 | 8.70 | 5 | 7000 | 2430 | 72 |
| 10 | 23 | 58.03 | 8.73 | 5 | 3450 | 2300 | 72 |
| 11 | 27 | 58.30 | 8.77 | 5 | 5700 | 2010 | 72 |

The properties for the above coatings made with Example 7 in Table 12 are well within typical range for a Coated Recycle Board mill. The coatings were drawn down on a precoated basesheet with the properties listed in Table 13. Comparative Example L is pre-coated basesheet.

TABLE 13

Coated Recycle Board Properties

| Coating #-Example | Parts Example 7 | Coating % Solids | TAPPI Brightness | L* | a* | b* | K + N | 75° Gloss |
|---|---|---|---|---|---|---|---|---|
| Comparative Example L | — | — | 65.12 | 84.82 | 0.31 | 0.90 | 37 | — |
| Example 9 | 19 | 58.29 | 78.98 | 91.47 | −0.49 | 0.79 | 17 | 52 |
| Example 10 | 23 | 58.03 | 79.87 | 91.72 | −0.50 | 0.63 | 18 | 53 |
| Example 11 | 27 | 58.30 | 80.28 | 91.89 | −0.47 | 0.47 | 19 | 52 |

As can be seen from Table 13, the target TAPPI Brightness of 80 and the target 75° gloss of greater than 50 were achieved by using the blended ATH/$TiO_2$ slurry of Example 7 in the top coat. The color (L*, a*, and b*) and the IGT pick strength were also well within typical performance for a coated recycle board application. Data reported was measured using standard Tappi methods.

What is claimed is:

1. An aqueous paper stock comprising a paper stock slurry of a blend of:

(a) pulp;

(b) a rutile titanium dioxide pigment slurry having a solids content from 50 wt. % to 92 wt. % by weight of the titanium dioxide pigment slurry; and (c) an alumina trihydrate extender pigment slurry, having a solids content of at least 67.5 wt. % by weight of the extender pigment slurry, comprising:

(i) at least 50% by weight of the extender pigment slurry of alumina trihydrate pigmentary particles having an average particle size of at least 0.5 micron;

(ii) a dispersant comprising an acrylic dispersing resin, and optionally citric acid;

(iii) a rheology modifier consisting of a synthetic hectorite clay in an amount from 0.1 up to about 1% by weight of the total extender pigment slurry formulation;

(iv) optionally a compound to adjust pH;

(v) a biocide; and (vi) water, wherein at least 50% by weight of the slurry is dispersed alumina trihydrate, whereby the slurry blend comprises 75 to about 50% by weight of rutile titanium dioxide and from 25% to about 50% alumina trihydrate.

2. The aqueous paper stock of claim 1 wherein the slurry blend is FDA compliant for indirect food contact.

3. The aqueous paper stock of claim 1 wherein at least 67-68% by weight of the alumina trihydrate extender pigment slurry is dispersed alumina trihydrate pigmentary particles.

4. The aqueous paper stock of claim 1 wherein the Brookfield viscosity of the extender pigment slurry is less than 1500 cps at 20 rpm.

* * * * *